US009052080B2

(12) United States Patent
Tsukamoto

(10) Patent No.: US 9,052,080 B2
(45) Date of Patent: Jun. 9, 2015

(54) VEHICULAR PROJECTOR HEADLAMP

(75) Inventor: Michio Tsukamoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 877 days.

(21) Appl. No.: 12/629,254

(22) Filed: Dec. 2, 2009

(65) Prior Publication Data

US 2010/0135037 A1 Jun. 3, 2010

(30) Foreign Application Priority Data

Dec. 2, 2008 (JP) ..... 2008-307069

(51) Int. Cl.

| | |
|---|---|
| ***F21S 8/10*** | (2006.01) |
| *F21V 29/02* | (2006.01) |
| *F21Y 101/02* | (2006.01) |

(52) U.S. Cl.

CPC ..... *F21S 48/325* (2013.01); *F21S 48/1104* (2013.01); *F21S 48/1159* (2013.01); *F21S 48/1323* (2013.01); *F21V 29/02* (2013.01); *F21Y 2101/02* (2013.01); *F21V 29/74* (2015.01)

(58) Field of Classification Search

CPC ... B60Q 1/00; F21Y 2101/00; F21Y 2103/00; F21V 1/00; F21V 29/02; F21S 48/1104; F21S 48/1159; F21S 48/1323; F21S 48/325

USPC ..... 362/545, 475, 487, 507, 508, 543

See application file for complete search history.

(56) References Cited

U.S. PATENT DOCUMENTS

| | | | | |
|---|---|---|---|---|
| 6,234,646 | B1 * | 5/2001 | Ito | 362/235 |
| 8,123,377 | B2 * | 2/2012 | Lundberg et al. | 362/243 |
| 2002/0191395 | A1 * | 12/2002 | Fleury | 362/236 |
| 2004/0125610 | A1 * | 7/2004 | Lekson et al. | 362/487 |
| 2004/0136196 | A1 * | 7/2004 | Akiyama | 362/487 |
| 2008/0112180 | A1 * | 5/2008 | Okada | 362/518 |
| 2011/0051452 | A1 * | 3/2011 | Shih | 362/547 |

FOREIGN PATENT DOCUMENTS

| | | |
|---|---|---|
| CH | 468896 A | 2/1969 |
| DE | 19652569 A1 | 6/1997 |
| EP | 1538392 A2 | 6/2005 |

(Continued)

OTHER PUBLICATIONS

European Search Report dated Apr. 11, 2012, issued in corresponding European Patent Application No. 09177742.5.

(Continued)

*Primary Examiner* — Anh Mai
*Assistant Examiner* — Jessica M Apenteng
(74) *Attorney, Agent, or Firm* — Sughrue Mion, PLLC

(57) ABSTRACT

A vehicular projector headlamp includes: a projection lens; a first LED element and a second LED element that are light sources and that are arranged on opposite sides of an optical axis of the projection lens so as to substantially face each other; a first reflector that has a first reflective surface having a first focal point located at the first LED element and a second focal point located in proximity to a rear focal point of the projection lens; and a second reflector that has a second reflective surface having a first focal point located at the second LED element and a second focal point located in proximity to the rear focal point of the projection lens, wherein the second reflective surface faces the first reflective surface.

14 Claims, 4 Drawing Sheets

(56) References Cited

FOREIGN PATENT DOCUMENTS

| | | | |
|---|---|---|---|
| EP | 1686310 | A1 | 8/2006 |
| JP | 62-147202 | U | 9/1987 |
| JP | 2003-317513 | A | 11/2003 |
| JP | 2005-108554 | A | 4/2005 |
| JP | 2006-164858 | A | 6/2006 |

OTHER PUBLICATIONS

Office Action issued in corresponding Japanese Patent Application No. 2008-307069, dated Nov. 8, 2012.

* cited by examiner

VEHICULAR PROJECTOR HEADLAMP

INCORPORATION BY REFERENCE

The disclosure of Japanese Patent Application No. 2008-307069 filed on Dec. 2, 2008 including the specification, drawings and abstract is incorporated herein by reference in its entirety.

BACKGROUND OF THE INVENTION

1. Field of the Invention

The invention relates to a vehicular projector headlamp that employs a plurality of LED elements as light sources and that emits a sufficient luminous flux.

2. Description of the Related Art

Japanese Patent Application Publication No. 2003-317513 (JP-A-2003-317513) describes a light source unit of a vehicular lamp. The light source unit employs an LED element as a light source. The light source unit includes a reflector. The reflector has a first focal point and a second focal point. The first focal point is located at the LED element that serves as the light source. The second focal point is located at a rear focal point of a projection lens. Light emitted from the LED element is reflected by the reflector toward a region proximate to the rear focal point of the projection lens. Part of the reflected light is blocked by a light control member (shade) located in proximity to the focal point to become diffused light, and exits forward of the projection lens.

Japanese Patent Application Publication No. 2005-108554 (JP-A-2005-108554) describes a vehicular headlamp that uses two semiconductor light-emitting elements as light sources. In the vehicular headlamp, the first and second semiconductor light-emitting elements are arranged on opposite sides of a forward travel blocking member (shade). Rays of light from the two light sources are respectively reflected by first and second reflectors toward a region proximate to a rear focal point of a projection lens. Then, light passing through the distal end of the forward travel blocking member becomes diffused light, and exits forward of the projection lens.

An LED element, for example, has advantages in that the luminous efficacy is high and the service life is long as compared with a filament bulb; however, it is difficult for a luminous flux of light emitted from the LED element to be diffused. In addition, in the light source unit described in JP-A-2003-317513, light emitted from the single LED element is reflected by the reflector to diffuse the luminous flux; however, the diffusion is insufficient to cause poor light distribution. Thus, in a vehicular headlamp that uses an LED element as a light source, as shown in FIG. 5, a plurality of light source units 21, which correspond to the above described light source unit, are provided in a lamp unit 24 arranged inside a lamp chamber S1 formed inside of a front cover 22 and a lamp body 23. In so doing, the luminous flux is increased to thereby enhance light distribution.

However, the flexibility of arrangement of the light source units 21 in the lamp chamber S1 is limited. Thus, when the plurality of light source units 21 are arranged, part of luminous flux (indicated by the broken line A in the drawing) of light emitted from an LED element 26 and reflected by a reflector 25 is blocked by a mounting portion 27 of the adjacent LED element as shown in FIG. 5. Therefore, there is a large loss of light flux, resulting in a decrease in a luminous flux condensed to a region proximate to the rear focal point of the projection lens.

Moreover, an LED element that emits a large amount of light is employed as a vehicular headlamp. Therefore, the LED element has a heating value higher than that of a general LED element. Thus, as described in JP-A-2005-108554, when the two semiconductor light-emitting elements are arranged on opposite sides of the shade, the radiation amount of heat generated by the two LED elements is small, and those LED elements are heated by the generated heat. This may decrease the intensity of luminous flux of the emitted light.

SUMMARY OF THE INVENTION

The invention provides a vehicular projector headlamp that employs a plurality of LED elements as light sources, that favorably condenses a luminous flux to a region proximate to the rear focal point of the projection lens, and that does not reduce in the intensity of luminous flux of each LED element due to heating.

A first aspect of the invention relates to a vehicular projector headlamp. The vehicular projector headlamp includes: a projection lens; a first LED element and a second LED element that are light sources and that are arranged on opposite sides of the optical axis of the projection lens so as to substantially face each other; a first reflector that has a first reflective surface having a first focal point located at the first LED element and a second focal point located in proximity to a rear focal point of the projection lens; and a second reflector that has a second reflective surface having a first focal point located at the second LED element and a second focal point located in proximity to the rear focal point of the projection lens, wherein the second reflective surface faces the first reflective surface.

A second aspect of the invention relates to a vehicular projector headlamp. The vehicular projector headlamp includes: a projection lens; a first LED element; a second LED element; a first reflector that has a curved first reflective surface having a first focal point located at the first LED element and a second focal point located in proximity to a focal point of the projection lens; and a second reflector that has a curved second reflective surface having a first focal point located at the second LED element and a second focal point located in proximity to the focal point of the projection lens, wherein the second reflective surface faces the first reflective surface. In the above headlamp, the first LED element emits light in a direction to approach the second LED element so that the emitted light strikes the first reflective surface, the second LED element emits light in a direction to approach the first LED element so that the emitted light strikes the second reflective surface, and the focal point of the projection lens is a focal point adjacent to the first reflector and the second reflector.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

An embodiment of the invention will now be described.

Figure 1:
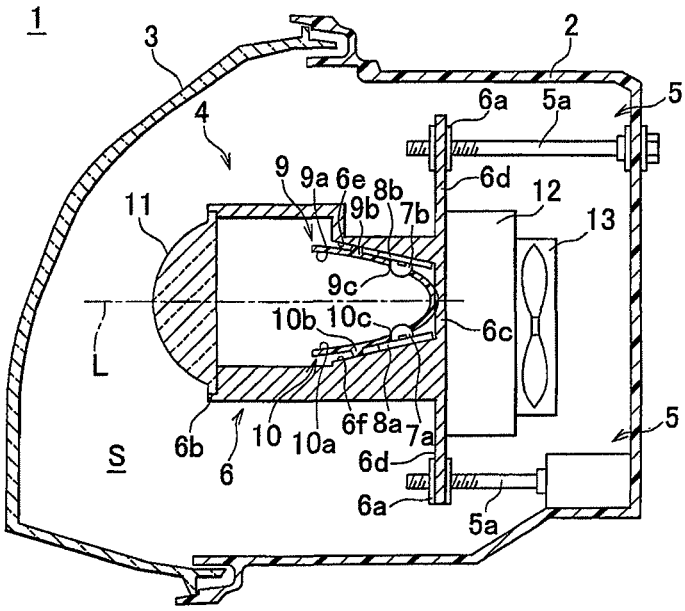
FIG. 1 is a vertical cross-sectional view of a vehicular headlamp according to an embodiment of the invention.
Figure 2:
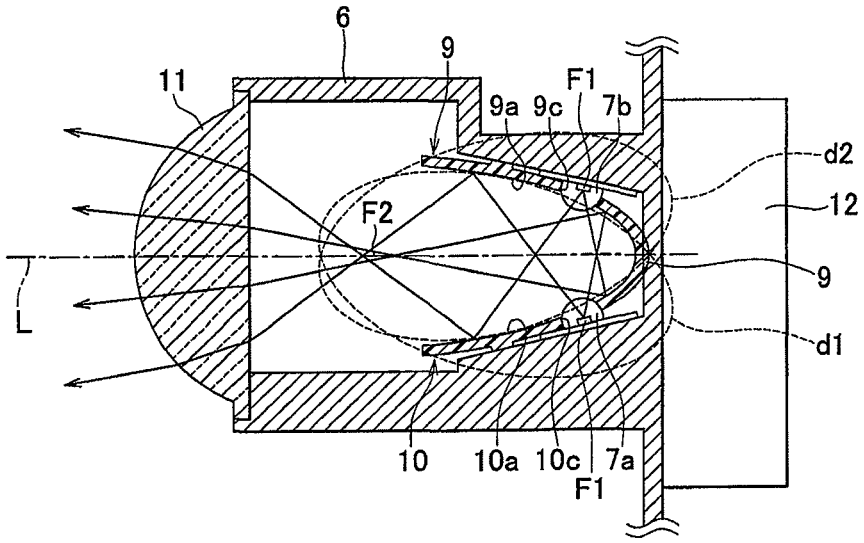
FIG. 2 is an enlarged vertical cross-sectional view that shows a portion around light sources and optical paths in FIG. 1.
Figure 3:
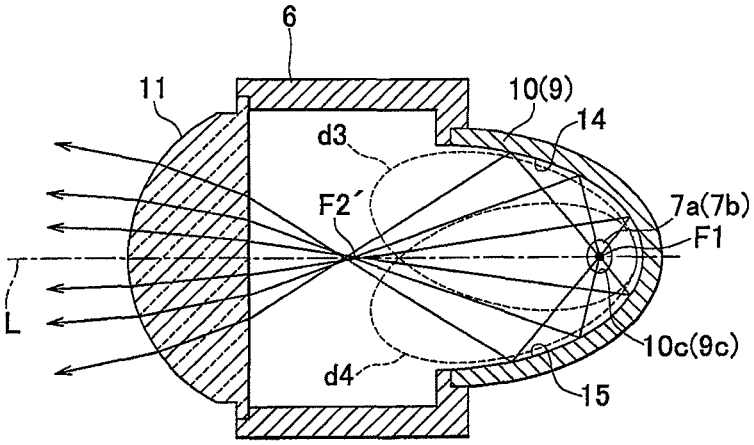
FIG. 3 is a horizontal cross-sectional view that shows a portion around the light sources and optical paths of the vehicular headlamp.
Figure 4:
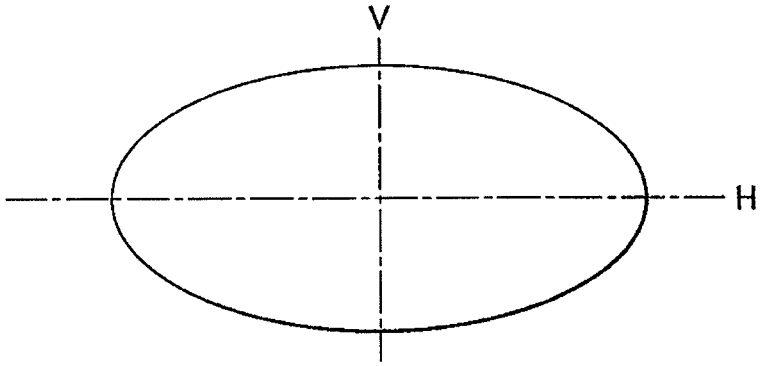
FIG. 4 is a view that shows a light distribution pattern irradiated to a light distribution screen.
Figure 5:
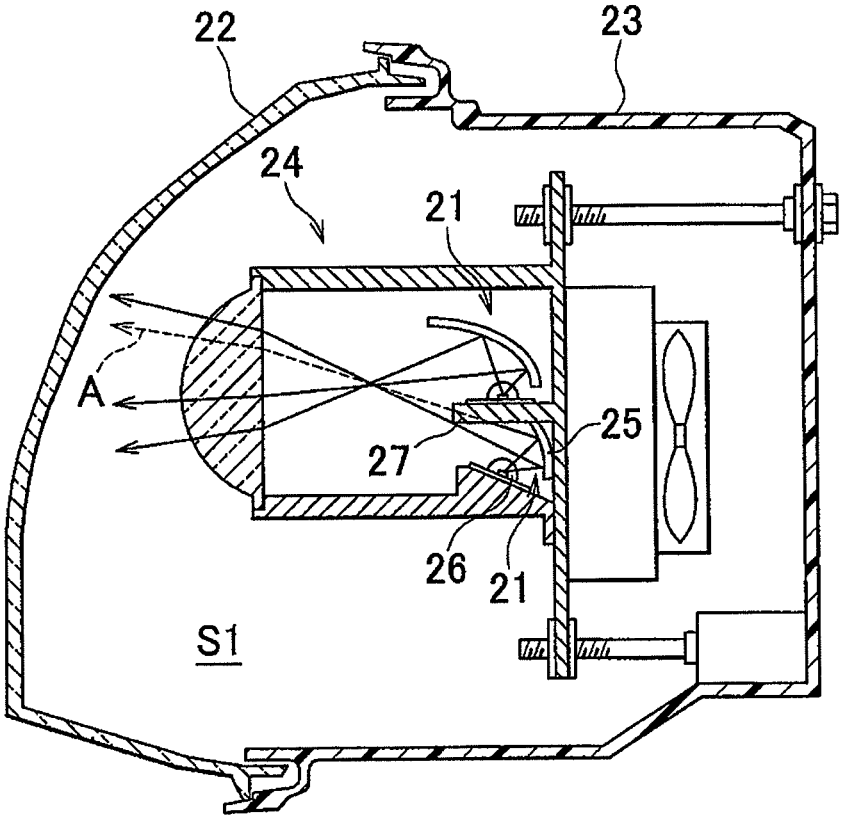
FIG. 5 RELATED ART
FIG. 5 is a vertical cross-sectional view of a vehicular headlamp, showing arrangement of light source units according to a related art.

FIG. 1 to FIG. 4 illustrate an embodiment of the invention. FIG. 1 is a vertical cross-sectional view of a vehicular projector headlamp according to the embodiment of the invention. FIG. 2 is an enlarged vertical cross-sectional view that shows a portion around light sources and optical paths in FIG. 1. FIG. 3 is a horizontal cross-sectional view that shows a portion around the light sources and optical paths of the vehicular headlamp. FIG. 4 is a view that shows a light distribution pattern irradiated to a light distribution screen.

As shown in FIG. 1, the vehicular projector headlamp 1 according to the present embodiment has a lamp chamber S. The lamp chamber S is formed inside a lamp body 2 and a front cover 3. The lamp body 2 and the front cover 3 are respectively located on a vehicle rear side and a vehicle front side with respect to each other. A lamp unit 4 is tiltably mounted on the lamp body 2 via an aiming mechanism 5 in the lamp chamber S.

The lamp unit 4 includes a lamp bracket 6, first and second LED elements 7*a* and 7*b*, circuit boards 8*a* and 8*b*, first and second reflectors 9 and 10, a projection lens 11, a radiator fin 12 and a cooling fan 13. The first and second LED elements 7*a* and 7*b* serve as light sources.

The aiming mechanism 5 is formed of multiple pairs of an aiming bolt 5*a* and a nut portion 6*a*. The aiming bolts 5*a* are rotatably supported by the lamp body 2. The nut portions 6*a* are provided for the lamp bracket 6. The lamp bracket 6 is movable in such a manner that the aiming bolts 5*a* advance or recede in the corresponding nut portions 6*a*. The lamp unit 4 tilts vertically and/or horizontally via the lamp bracket 6.

The lamp bracket 6 has a closed-end hollow shape. The lamp bracket 6 has an opening 6*b* that is open forward and a bottom 6*c* at the proximal end. The nut portions 6*a* are provided for a tiltable wall 6*d* extending vertically from the bottom 6*c*. The projection lens 11 is fixed to the opening 6*b*. Mounting surfaces 6*e* and 6*f* are formed on the inner side of the lamp bracket 6. The mounting surfaces 6*e* and 6*f* are respectively continuous with the upper and lower ends of the bottom 6*c* on the inner side thereof, and are inclined so as to diverge toward the front on opposite sides of an optical axis L of the projection lens 11. The circuit boards 8*a* and 8*b* are respectively fixed to the LED surface 6*f* and 6*e*. The pair of LED elements 7*a* and 7*b* are respectively mounted on the circuit boards 8*a* and 8*b*. The radiator fin 12 is provided on the rear surface of the bottom 6*c* of the lamp bracket 6. The cooling fan 13 is mounted on the radiator fin 12.

In addition, the first reflector 9 is arranged above the optical axis L of the projection lens 11, and the second reflector 10 is arranged below the optical axis L. First and second reflective surfaces 9*a* and 10*a* are respectively formed on the inner sides of the first and second reflectors 9 and 10. The first and second reflective surfaces 9*a* and 10*a* have part of a substantially ellipsoidal shape. The first and second reflective surfaces 9*a* and 10*a* are continuous to each other at the proximal ends thereof, and are arranged substantially symmetrically with respect to the optical axis L. In addition, the first and second reflectors 9 and 10 respectively have legs 9*b* and 10*b* on the back sides of the reflective surfaces 9*a* and 10*a*. The first and second reflectors 9 and 10 are respectively mounted on the LED mounting surfaces 6*e* and 6*f* by the legs 9*b* and 10*b*.

The first reflector 9 has a through hole 9*c*. The through hole 9*c* is formed through the reflective surface 9*a* at a location corresponding to the second LED element 7*b*. The second reflector 10 has a through hole 10*c*. The through hole 10*e* is formed through the reflective surface 10*a* at a location corresponding to the first LED element 7*a*. When the reflectors 9 and 10 are mounted on the mounting surfaces 6*e* and 6*f*, respectively, the second LED element 7*b* and the first LED element 7*a* are respectively exposed on the reflective surfaces 9*a* and 10*a* through the through holes 9*c* and 10*c*, and are arranged on opposite sides of the optical axis L so as to substantially face each other.

The vertical cross sections of the first and second reflectors 9 and 10, including the optical axis L, are as shown in FIG. 2. The first and second reflective surfaces 9*a* and 10*a* are formed into a shape such that parts of the curves of two ellipses d1 and d2 arranged substantially symmetrically with respect to the optical axis L of the projection lens 11 are vertically continuous with each other. The ellipses d1 and d2 are arranged so that the respective major axes are substantially symmetrical with respect to the optical axis L and are inclined so as to taper toward the front. The reflective surface 9*a* is formed along a partial arc of the ellipse d1 of which the major axis is inclined downward with respect to the optical axis L from the front toward the rear. The reflective surface 10*a* is formed along a partial arc of the ellipse d2 of which the major axis is inclined upward with respect to the optical axis L from the front toward the rear.

The horizontal cross sections of the first and second reflectors 9 and 10, including the optical axis L, are as shown in FIG. 3. Left and right reflective surfaces 14 and 15 are formed into a shape such that parts of curves of two ellipses d3 and d4 arranged substantially symmetrically with respect to the optical axis L of the projection lens 11 are horizontally continuous with each other. The ellipses d3 and d4 are arranged so that the respective major axes are substantially symmetrical with respect to the optical axis L and are inclined so as to diverge toward the projection lens 11 ahead. That is, a distance between a portion of the left reflective surface 14, close to the projection lens 11, and the optical axis L is larger than a distance between a portion of the left reflective surface 14, far from the projection lens 11, and the optical axis L. In addition, a distance between a portion of the right reflective surface 15, close to the projection lens 11, and the optical axis L is larger than a distance between a portion of the right reflective surface 15, far from the projection lens 11, and the optical axis L. The right reflective surface 14 of the reflective surfaces 9*a* and 10*a* is formed along a partial arc of the ellipse d3 of which the major axis is inclined downward with respect to the optical axis L from the front toward the rear. The left reflective surface 15 of the reflective surfaces 9*a* and 10*a* is formed along a partial arc of the ellipse d4 of which the major axis is inclined upward with respect to the optical axis L from the front toward the rear.

Next, light distribution formed by the first reflector 9 and the second reflector 10 in the vertical cross-sectional direction will be described with reference to FIG. 2. Light emitted from the first LED element 7*a* (first focal point F1) is reflected by the facing first reflective surface 9*a* toward the rear focal point, that is, a region proximate to F2 that is a focal point adjacent to the first reflector 9 and the second reflector 10, of the projection lens 11. Light emitted from the second LED element 7*b* (first focal point F1) is reflected by the facing second reflective surface 10*a* toward a region proximate to the rear focal point F2 of the projection lens 11 as in the case of the light emitted from the first LED element 7*a*. Light condensed in proximity to F2 enters the projection lens 11 and exits forward of the projection lens 11 in form of a substantially parallel light flux.

Next, light distribution formed by the first and second reflectors 9 and 10 in the horizontal cross-sectional direction will be described with reference to FIG. 3. Light emitted from each of the first and second LED elements 7*a* and 7*b*, that is, the first focal points F1, arranged one above the other on opposite sides of the optical axis L is reflected by the left and right reflective surfaces 14 and 15 toward a region proximate to the rear focal point F2' of the projection lens 11, enters the projection lens 11 and then through the front of the projection lens 11 in form of a substantially parallel light flux. A luminous flux in the vehicular headlamp according to the present embodiment diffuses widely in the vertical cross-sectional direction than in the horizontal cross-sectional direction, and forms a horizontally long elliptical distribution pattern, as shown in FIG. 4.

As described above, with the vehicular projector headlamp according to the present embodiment, although the plurality of LED elements are arranged as light sources, owing to the mounting structure of the LED elements, the luminous flux condensed in proximity to the rear focal point of the projection lens does not decrease as a result of the mounting structure of the LED elements and, in addition, the LED elements are not excessively heated by each other. Therefore, it is possible to obtain a vehicular projector headlamp in which the luminous flux emitted from the LED elements is sufficiently produced and is hard to decrease.

The overview of the above-described present embodiment will be described below.

The vehicular projector headlamp according to the present embodiment includes: a projection lens; a first LED element and a second LED element that are light sources and that are arranged on opposite sides of an optical axis of the projection lens so as to substantially face each other; a first reflector that has a first reflective surface having a first focal point located at the first LED element and a second focal point located in proximity to a rear focal point of the projection lens; and a second reflector that has a second reflective surface having a first focal point located at the second LED element and a second focal point located in proximity to the rear focal point of the projection lens, wherein the second reflective surface faces the first reflective surface.

With the above configuration, the first and second reflectors are arranged so as to face each other. Thus, luminous fluxes of light emitted from the first and second LED elements are respectively reflected by the first and second reflectors toward the rear focal point of the projection lens without any loss. Therefore, losses in luminous flux are reduced. In addition, the first and second LED elements are positioned on opposite sides of the optical axis of the projection lens so as to be spaced apart from each other. Thus, heat generated in the first and second LED elements is easily radiated. This suppresses excessive heating of the first and second LED elements by the heat generated in the facing second and first LED elements.

In the vehicular projector headlamp according to the present embodiment, a first through hole may be formed in the first reflector so that the second LED element is exposed on the first reflective surface, and a second through hole may be formed in the second reflector so that the first LED element is exposed on the second reflective surface.

With the above configuration, only the second and first LED elements are exposed respectively through the first and second through holes on the first and second reflective surfaces, and the mounting structures of the LED elements are not exposed to the respective reflective surface sides. Thus, the luminous fluxes emitted from the first and second LED elements are not blocked by those mounting structures but reflected toward the rear focal point of the projection lens, thereby reducing losses in luminous flux. In addition, the first and second LED elements are arranged on opposite sides of the optical axis of the projection lens and the first and second reflectors so as to be spaced apart from each other. This suppresses heating of the first and second LED elements by heat generated in the respectively facing second and first LED elements.

In the headlamp according to the present embodiment, the first LED element may emit light in a direction to approach the second LED element so that the emitted light strikes the first reflective surface, and the second LED element may emit light in a direction to approach the first LED element so that the emitted light strikes the second reflective surface.

In the headlamp according to the present embodiment, a distance between the first LED element and the first reflective surface may be larger than a distance between the second LED element and the first reflective surface, and a distance between the second LED element and the second reflective surface may be larger than a distance between the first LED element and the second reflective surface.

In the headlamp according to the present embodiment, a distance between the first LED element and the second LED element may be larger than any one of a distance between the first LED element and the optical axis of the projection lens and a distance between the second LED element and the optical axis of the projection lens.

In the headlamp according to the present embodiment, a cross section of at least one of the first reflective surface and the second reflective surface, including the optical axis of the projection lens, may have part of an elliptic curve.

In the headlamp according to the present embodiment, the first LED element and the second LED element may be arranged at locations that are symmetrical with respect to the optical axis of the projection lens, and the first reflective surface and the second reflective surface may be arranged at locations that are symmetrical with respect to the optical axis of the projection lens.

In the headlamp according to the present embodiment, a distance between a portion of the first reflective surface, close to the projection lens, and the optical axis of the projection lens may be larger than a distance between a portion of the first reflective surface, far from the projection lens, and the optical axis of the projection lens, and a distance between a portion of the second reflective surface, close to the projection lens, and the optical axis of the projection lens may be larger than a distance between a portion of the second reflective surface, far from the projection lens, and the optical axis of the projection lens.

In the headlamp according to the present embodiment, the rear focal point of the projection lens may be a focal point adjacent to the first reflector and the second reflector.

In the headlamp according to the present embodiment, a plane that includes the second LED element and the optical axis and a plane that includes the first LED element and the optical axis may intersect at an obtuse angle.

A vehicular projector headlamp according to another embodiment of the invention includes a projection lens; a first LED element; a second LED element; a first reflector that has a curved first reflective surface having a first focal point located at the first LED element and a second focal point located in proximity to a focal point of the projection lens; and a second reflector that has a curved second reflective surface having a first focal point located at the second LED element and a second focal point located in proximity to the focal point of the projection lens, wherein the second reflective surface faces the first reflective surface. In the above headlamp, the first LED element emits light in a direction to approach the second LED element so that the emitted light strikes the first reflective surface, the second LED element emits light in a direction to approach the first LED element so that the emitted light strikes the second reflective surface, and the focal point of the projection lens is a focal point adjacent to the first reflector and the second reflector.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

What is claimed is:

1. A vehicular projector headlamp comprising:

a projection lens;

a first LED element and a second LED element that are light sources and that are arranged on opposite sides of an optical axis of the projection lens so as to substantially face each other;

a first reflector that has a curved first reflective surface having a first focal point located at the first LED element and a second focal point located in proximity to a rear focal point of the projection lens; and a second reflector that has a curved second reflective surface having a first focal point located at the second LED element and a second focal point located in proximity to the rear focal point of the projection lens, wherein the second reflective surface faces the first reflective surface;

wherein a cross section of at least one of the first reflective surface and the second reflective surface, including the optical axis of the projection lens, has part of an elliptic curve;

the first reflective surface and the first LED element are arranged on opposite sides of the optical axis of the projection lens such that light emitted from the first LED element is reflected by the first reflective surface, and the second reflective surface and the second LED element are arranged on opposite sides of the optical axis of the projection lens such that light emitted from the second LED element is reflected by the second reflective surface.

2. The headlamp according to claim 1, wherein a first through hole is formed in the first reflector so that the second LED element is exposed on the first reflective surface, and a second through hole is formed in the second reflector so that the first LED element is exposed on the second reflective surface.

3. The headlamp according to claim 1, wherein the first LED element emits light in a direction to approach the second LED element so that the emitted light strikes the first reflective surface, and the second LED element emits light in a direction to approach the first LED element so that the emitted light strikes the second reflective surface.

4. The headlamp according to claim 1, wherein a distance between the first LED element and the first reflective surface is larger than a distance between the second LED element and the first reflective surface, and a distance between the second LED element and the second reflective surface is larger than a distance between the first LED element and the second reflective surface.

5. The headlamp according to claim 1, wherein a distance between the first LED element and the second LED element is larger than any one of a distance between the first LED element and the optical axis of the projection lens and a distance between the second LED element and the optical axis of the projection lens.

6. The headlamp according to claim 1, wherein the first LED element and the second LED element are arranged at locations that are symmetrical with respect to the optical axis of the projection lens, and the first reflective surface and the second reflective surface are arranged at locations that are symmetrical with respect to the optical axis of the projection lens.

7. The headlamp according to claim 1, wherein a distance between a portion of the first reflective surface, close to the projection lens, and the optical axis of the projection lens is larger than a distance between a portion of the first reflective surface, far from the projection lens, and the optical axis of the projection lens, and a distance between a portion of the second reflective surface, close to the projection lens, and the optical axis of the projection lens is larger than a distance between a portion of the second reflective surface, far from the projection lens, and the optical axis of the projection lens.

8. The headlamp according to claim 1, wherein the rear focal point of the projection lens is a focal point adjacent to the first reflector and the second reflector.

9. The headlamp according to claim 1, wherein a plane that includes the second LED element and the optical axis and a plane that includes the first LED element and the optical axis intersect at an obtuse angle.

10. A vehicular projector headlamp comprising:

a projection lens;

a first LED element;

a second LED element;

a first reflector that has a curved first reflective surface having a first focal point located at the first LED element and a second focal point located in proximity to a focal point of the projection lens; and a second reflector that has a curved second reflective surface having a first focal point located at the second LED element and a second focal point located in proximity to the focal point of the projection lens, wherein the second reflective surface faces the first reflective surface, wherein the first LED element emits light in a direction to approach the second LED element so that the emitted light strikes the first reflective surface, the second LED element emits light in a direction to approach the first LED element so that the emitted light strikes the second reflective surface, and the focal point of the projection lens is a focal point adjacent to the first reflector and the second reflector;

wherein a cross section of at least one of the first reflective surface and the second reflective surface, including the optical axis of the projection lens, has part of an elliptic curve;

the first reflective surface and the first LED element are arranged on opposite sides of the optical axis of the projection lens such that light emitted from the first LED element is reflected by the first reflective surface, and the second reflective surface and the second LED element are arranged on opposite sides of the optical axis of the projection lens such that light emitted from the second LED element is reflected by the second reflective surface.

11. The headlamp according to claim 10, wherein a distance between the first LED element and the first reflective surface is larger than a distance between the second LED element and the first reflective surface, and a distance between the second LED element and the second reflective surface is larger than a distance between the first LED element and the second reflective surface.

12. The headlamp according to claim 10, wherein a distance between the first LED element and the second LED element is larger than any one of a distance between the first LED element and the optical axis of the projection lens and a distance between the second LED element and the optical axis of the projection lens.

13. The headlamp according to claim 10, wherein the first LED element and the second LED element are arranged at locations that are symmetrical with respect to the optical axis of the projection lens, and the first reflective surface and the second reflective surface are arranged at locations that are symmetrical with respect to the optical axis of the projection lens.

14. The headlamp according to claim 10, wherein a distance between a portion of the first reflective surface, close to the projection lens, and the optical axis of the projection lens is larger than a distance between a portion of the first reflective surface, far from the projection lens, and the optical axis of the projection lens, and a distance between a portion of the second reflective surface, close to the projection lens, and the optical axis of the projection lens is larger than a distance between a portion of the second reflective surface, far from the projection lens, and the optical axis of the projection lens.

* * * * *